United States Patent [19]

Becker

[11] Patent Number: 4,867,407

[45] Date of Patent: Sep. 19, 1989

[54] PORTABLE BOOK HOLDER

[76] Inventor: Fred R. Becker, 315 Central Ave., Glenside, Pa. 19038

[21] Appl. No.: 151,544

[22] Filed: Feb. 2, 1988

[51] Int. Cl.[4] ..... A47B 97/04

[52] U.S. Cl. ..... 248/444.1; 248/447.2; 248/445

[58] Field of Search ..... 248/444.1, 447.2, 448, 248/445, 446, 449, 460, 447

[56] References Cited

U.S. PATENT DOCUMENTS

| | | | |
|---|---|---|---|
| 1,017,698 | 2/1912 | Stevenson | 248/444.3 X |
| 2,359,895 | 10/1944 | Burton | 248/447.2 X |
| 2,896,364 | 7/1959 | McCollister | 248/447.2 X |
| 3,351,312 | 11/1967 | Ballas | 248/447.2 X |
| 3,514,066 | 5/1970 | Singleton et al. | 248/445 |
| 3,740,015 | 6/1973 | Adams | 248/445 |
| 3,889,914 | 6/1975 | Torme | 248/447.2 X |
| 3,905,573 | 9/1975 | Davis | 248/445 |
| 4,596,372 | 6/1986 | Ford | 248/441.1 |
| 4,681,291 | 7/1987 | Holladay | 248/444.1 |
| 4,685,647 | 8/1987 | Calhoun | 248/444.1 |

*Primary Examiner*—Ramon O. Ramirez
*Attorney, Agent, or Firm*—John Shaw Stevenson

[57] ABSTRACT

A support is characterized by having a bendable arm that has an inner nonmoveable, longitudinal end portion thereof retained in a stationary position and an outer bendable free end portion extending through and in supporting contact with a wall that forms a passageway that extends through the base of an object to be supported so that the object can be moved about its stationary end to any desired horizontal, vertical or angularly displaced position.

10 Claims, 2 Drawing Sheets

PORTABLE BOOK HOLDER

BACKGROUND OF THE INVENTION

Applicant's preferred form of his invention relates to a unique support in which a bendable rod, in the form of a cantilever, is used to support an object such as a book rest, a drill, a saw or a light.

Applicant's invention also relates to a unique support in which two of these bendable rods are employed to support an object such as a book rest in any one of a variety of vertical, horizontal or angular positions on the free longitudinal portion of the rods and is able to move the object and retain it without movement in any one of the other aforementioned positions.

Prior supports such as book rests have accomplished this feat by employing various types of arms that are made by spiraling a thin strip of metal into a tube-shaped construction. This spiral tube has to be made of a relatively thin construction. When continuous bending of the tube occurs, it causes metal fatigue. Difficulty has been encountered when this takes place as the end and central portions of these arms have a tendency to untwist and return to their original, unspiraled strip metal condition. This, in turn, will prevent the spiral arm from retaining the, e.g., a book rest and a book supported thereon in a desired position for reading.

Other prior supports such as for book rests have used tubular constructions connected at their ends by universal socket joints. Such constructions, after being used over short periods of time, have not been satisfactory because the slippage which occurs at these joints cause the angle at which these tubes support the base and object thereon to be altered to an undesired position.

The cantilever type rod book rest support covered by this invention eliminates all of the aforementioned metal fatigue and undesired support arm displacement problems and enables the base of an object such as a book rest to be manually moved from one desired position to another without encountering these problems.

SUMMARY OF THE INVENTION

The subject support can be advantageously used to move an object such as a book rest that is mounted on a headboard of a bed to any one of a number of positions so that a book supported by the book rest can be located in a suitable position for reading by a person occupying the bed. The present support is constructed of a bendable rod made of a #7 gage, 1006–1008 carbon steel material. While this rod be manually bent, its gage is sufficiently strong so that the weight of the book rest and a book supported thereon will not change its position once the rod and the base of the book rest are simultaneously manually moved to a desired position.

Another advantage derived from the use of a bendable cantilever rod support is that, since the free end of the rod is able to move relative to the support, it does not encounter the undesired metal fatigue or slippage problem of conventional book rest tubular supports that require this end of the tube to be fixedly connected to the book rest

DETAILED DESCRIPTION OF THE DRAWING

Figure 1:
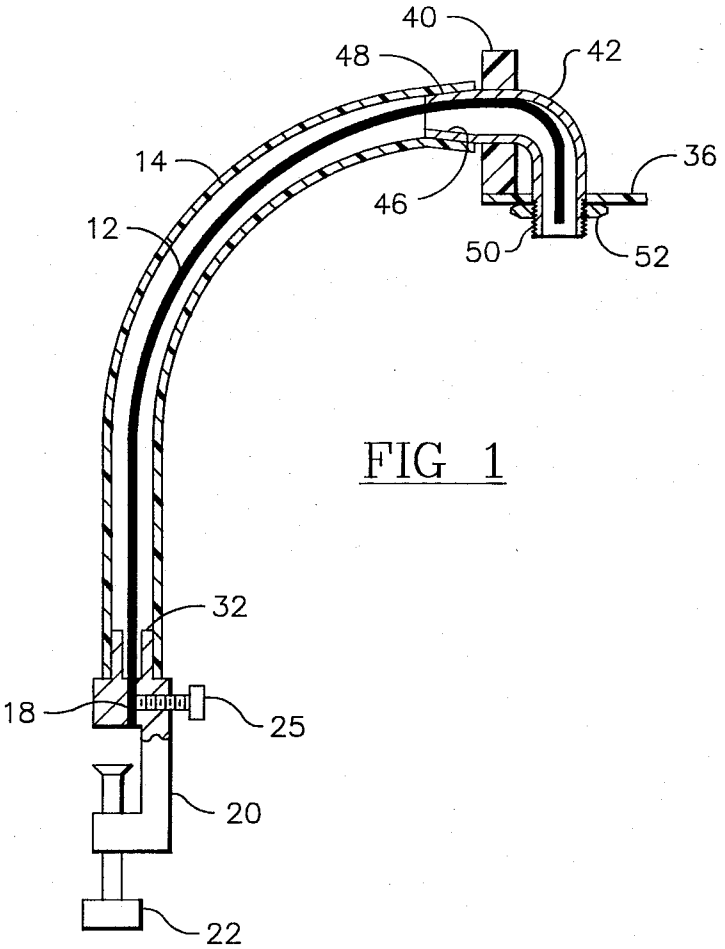
FIG. 1 shows in cross section a detail of the support and shows opposite ends connected to a clamp and to an object it is supporting.

The preferred single rod support embodiment of the invention is shown in FIG. 1. FIG. 3 will be described in conjunction with FIG. 1 to illustrate how the two single rods of FIG. 2 can be used in place of the single rod of FIG. 1. Referring to FIG. 1 and FIG. 3, the support is designated by reference number 10 and is made preferably of a #7 gage, 1006–1008 carbon steel. The support 10 includes two identical relatively stiff bendable rods 12 each of which is of the type shown in FIG. 1. Surrounding a first one of these rods 12 is a flexible plastic tube 14 which may be of a construction similar to that of a garden hose. FIG. 3 shows that another tube 16, which is identical to the tube 14, is also employed about its associated rod 12.

As is best shown in FIG. 1, one end of the rod 12 is inserted through a passageway 18 in the upper end of a retaining means such as a C-clamp 20 that contains an adjustable jaw 22. The clamp 24 in FIG. 3 is identical to the clamp 20 and each of these clamps 20, 24 has a tap bolt 25 to retain one end of each of their respective rods 12 in fixed relation with its clamp.

The C-clamps 20,24 are shown in a fixed clamped engagement with two different portions 26,28 of a headboard, of a bed not shown, on which the head 30 of an occupant is resting. One end of each of the tubes 14,16 is shown fitted in pressed fit engagement with the outside surface of a tubular member 32 that extends from and forms a part of the top of each clamp 20,24 as shown for clamp 20 in FIG. 1.

FIG. 3 also shows a book rest 34 with a transparent, preferably plexiglass, base portion of shelf 36 on which an opened book 38 is positioned. The book rest 34 also has an upright base portion 40 and two elbow members 42,44 as is best shown in FIG. 1. The upper end portion 46 of elbow member 42 is shown to be of a tapered, truncated configuration so that the inner wall 48 of the tube 14 can be press fitted into its flared surface to surface engagement with the outer wall of this tapered portion 46 as shown. The other lower end 50 of elbow member 42 is threaded as best shown in FIG. 1 and has a nut 52 threaded thereon. It should be understood that the other elbow 44 is connected to the tube 16 and mounted in the same manner on the base of the book rest 34 as the aforementioned described elbow 42.

From the aforementioned description of the support 10 and book rest 34 it can be seen that the shelf supporting nut 52 mounted on the end of each elbow 42,44 and the press fit relationship that exists between the non-threaded end 46 of these identical elbow 42,44 and the base portion 40 of the book rest will retain the base portion formed by transparent shelf 36 and the base portion 40 of the shelf 36 in a fixed relation with each other. Each bendable rod 12 within the respective tubes 14,16 extends in a cantilever fashion away from their respective clamps 20,24 and has an outer free end portion hat has a longitudinal surface thereof in contact with an inner wall portion of their respective elbows 42,44 and for movement therealong in the manner shown in FIG. 1.

Figure 2:
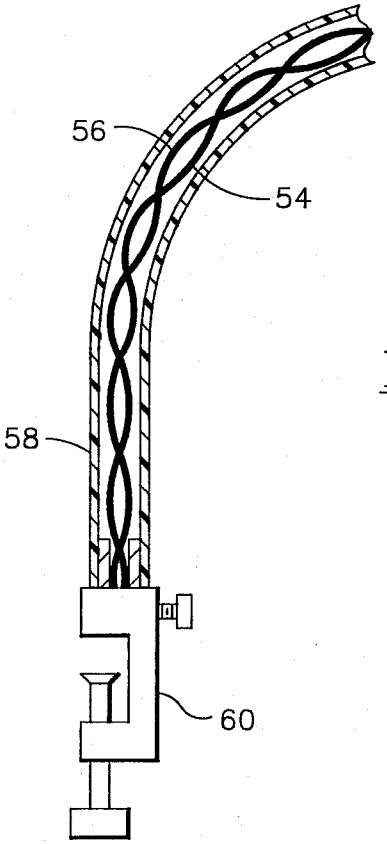
FIG. 2 is a modified form of the support shown in FIG. 1 in which two bent rods instead of one are employed for supporting the base portion of the object.
Figure 3:
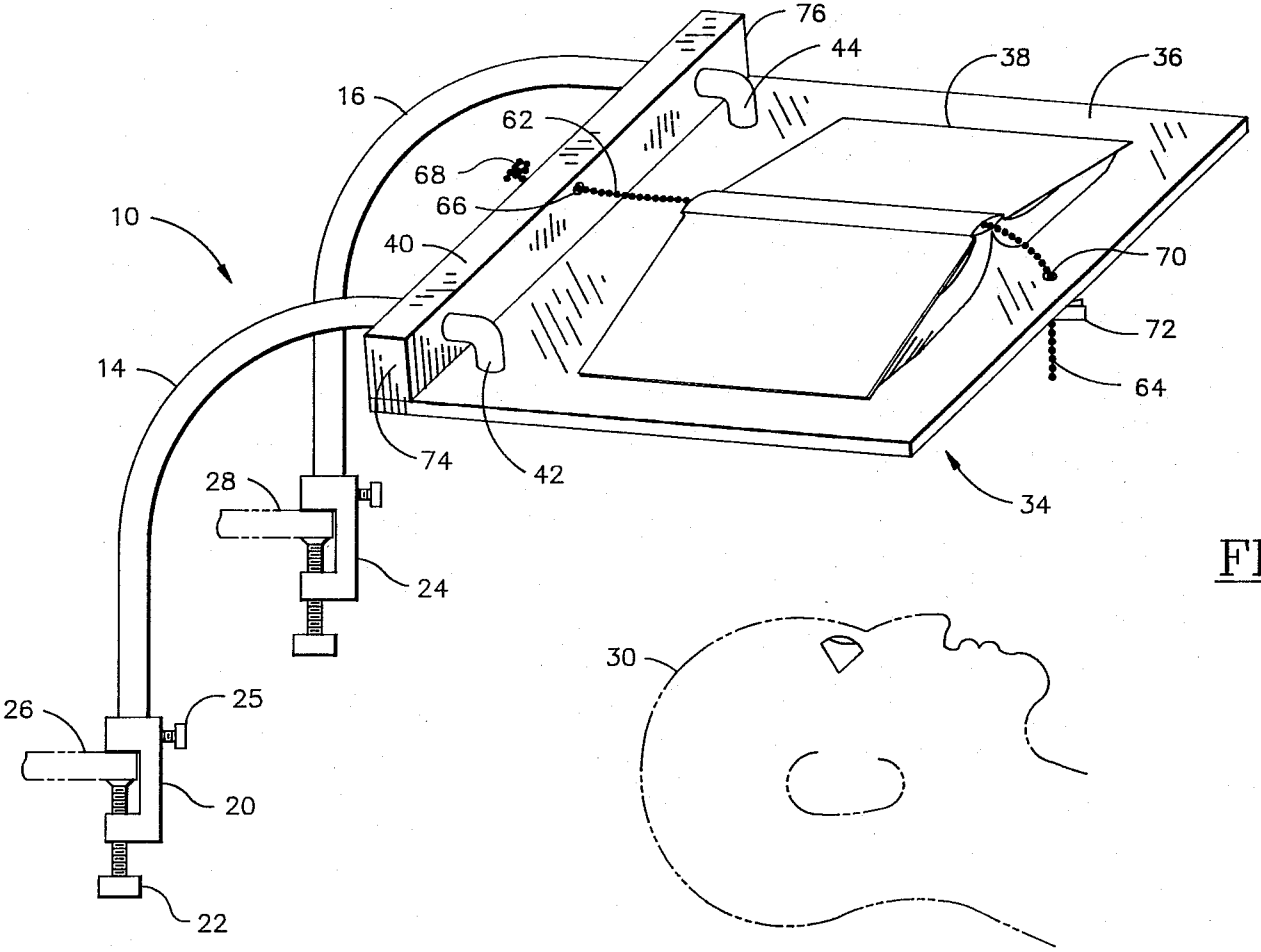
FIG. 3 is a perspective view showing the support used to support two parts of the base of a book rest and how it provides a connection between a clamp connected to the headboard of a bed and the base of the book rest.

FIG. 2 is a modified form of the invention in which two steel rods 54,56 longitudinally wrapped about one another are employed in lieu of the single rod construction 12 as shown in FIG. 1. These rods are made of the same bendable carbon steel material as rod 12 and preferably are made of a lower cross section or gage than rod 12. The length of the wires 54,56 the type of tube 58. C-clamp 60 and the manner in which they are located with respect to the elbow 42 are identical to that shown in FIG. 1.

The aforementioned book rest support 10 allows the book shelf 36 to be adjusted upwardly, downwardly or to the right or left of the position shown so that the shelf 36 and the book thereon can be located in a desired reading position for the reader 30. For example, as the book shelf 36 is moved down by moving the rods 12 in tubes 14,16 or by moving the shelf 36 in this direction, the shelf supporting rod in the tube will be bent and be moved to another support contact position with respect to the inner surface of elbows 42,44 as shown in detail in FIG. 1.

FIG. 3 shows a string 62 containing separated beads 64 thereon. One end of the string of beads 64 passes through a wall 66 forming a passageway in the base 40 and is shown threaded into a knot 68 on the left side wall of the base 40. The remaining portion of the string of beads 64 passes between an end portion of the book cover and the end of the pages that are bound together. The remaining beads are passed through a wall 70 forming a passageway in the shelf 36. The leaves of the book are retained in a fixed position against the plexiglass shelf 36 by pulling this end of the beads through passageway 70 and by inserting a spring biased clip 72; e.g., a tie clip, over the string of beads 64 that are immediately below the bottom surface of the shelf 36. It can be seen that this bead construction has an advantage over prior art book holding devices in that any size book can be placed on shelf 36.

It should be understood that in the preferred form of the invention a single rod support 12 per se such as is shown in FIG. 1 can be employed to support the book rest support 34 shown in FIG. 3. When this is done, the single rod support 12 of FIG. 1 will preferably be connected to the book rest 34 halfway between the ends 74,76 of its base portion 40.

It should also be understood that such a single rod support 12 per se that is shown in FIG. 1, can readily be employed to support many different types of objects such as a drill, a saw or a light. In these cases the support rod 12 can be mounted by means of the clamp 20 to; e.g., a workbench, or desk and the opposite end, containing the elbow, passed through any type of base on which a book rest, drill, saw, light or other object is mounted. In this way, the basic, single rod 12 form of the invention can be benefically employed to move any one of a number of the aforementioned objects in a vertically, horizontally or angularly displaced position with respect to the stationary clamped end of the rod 12.

What is claimed is:

1. A support comprising:

a base for supporting an object thereon, a bendable rod, a retaining means for holding one end portion of the rod in a stationary position, said base having an upright wall portion extending therefrom and having an elbow member forming a passageway between said wall portion and said base the other end portion of said rod having an outer longitudinal surface positioned to extend through said wall portion and into contact with said elbow for movement there along.

said rod and said base being moveable about said retaining means to thereby position the object in any desired position.

2. The support of claim 1 wherein the passageway extending through said base is constructed of a hard, hollow shaped material.

3. The support of claim 1 wherein said rod is constructed of bendable carbon steel material.

4. The support of claim 1 wherein the size of the cross sectional dimension of said rod is of a number 7 gage material.

5. The support of claim 1 wherein the rod is made of a two-piece construction and formed by wrapping two rods longitudinally about one another.

6. The support of claim 5 wherein a hose surrounds said rod and wherein said hose having one end retained on the outer surface of one end of the wall forming the said passageway in said base and the other end of said hose connected to and retained by said retaining means.

7. A book rest support comprising:

a rest for supporting a book thereon, a support having a pair of bendable rods, each of said rods forming a cantilever beam that includes a stationary end portion and a moveable end portion extending away from the fixed end portion, said book rest having an upright wall portion extending therefrom and having two spaced apart elbow members forming passageways between said wall portion and said book rest, the moveable end portion of one rod being positioned to extend through and in longitudinal supporting contact with a first one of said elbows that form one of said passageways, and the moveable end of the other rod being positioned to extend through and in longitudinal supporting contact with the other elbow that forms the second passageway, said rods and said book rest being simultaneously moveable to any one of a plurality of selected vertical, horizontal or angularly displaced positions so that a book supported by said book rest can be located in a desired position for reading.

8. The support of claim 7 wherein the passageways extending through said book rest are each constructed of a hard material having one leg of the elbow extending outwardly of said book rest and having a nut threadly connected to said leg and in surface to surface engagement with an outside surface of said book rest.

9. The support of claim 7 wherein each passageway extending through said book rest is constructed of a hard material having one leg of the elbow extending outwardly of said book rest and having a nut threadly connected to said leg and in surface to surface engagement with an outside surface of said book rest and wherein the outside diameter of another leg of each elbow is in press fit engagement with another portion of said book rest and has an inwardly tapered end extending beyond the outside surface of said book rest, a separate hose surrounding each rod and having one end engaging the outer surface of the tapered end of said elbow and its other end being in snug fit relationship with the outside surface of a sleeve that forms the stationary end portion of each rod.

10. The support of claim 7 wherein a string of beads is employed to extend through the space between the end of the cover of said book and the bound end of the pages of the book, a passageway in the upper and lower portions of said book rest, each end portion of said beads extending through a different one of said passageways and a knot in one end of said beads and a retaining clip at the other end of said beads to retain the beads in tight relationship with the book and the pages of the book pressed against the book rest.

* * * * *